United States Patent [19]

Hirano

[11] Patent Number: 4,762,434

[45] Date of Patent: Aug. 9, 1988

[54] RIBBON FEED DEVICE

[75] Inventor: Horofumi Hirano, Arakawa, Japan

[73] Assignee: Canon Kabushiki Kaisha, Tokyo, Japan

[21] Appl. No.: 32,999

[22] Filed: Mar. 30, 1987

Related U.S. Application Data

[63] Continuation of Ser. No. 731,396, May 7, 1985, abandoned.

[30] Foreign Application Priority Data

May 10, 1984 [JP] Japan ..... 59-91874

[51] Int. Cl.[4] ..... B41J 33/22; B41J 33/36

[52] U.S. Cl. ..... 400/236.2; 400/232; 74/812; 74/354

[58] Field of Search ..... 400/232, 236, 236.2; 74/812, 810, 354

[56] References Cited

U.S. PATENT DOCUMENTS 4,572,027 2/1986 Lusk ..... 74/812

*Primary Examiner*—William Pieprz

*Attorney, Agent, or Firm*—Fitzpatrick, Cella, Harper & Scinto

[57] ABSTRACT

A ribbon feed device includes; a drive gear capable of rotating about a first shaft in clockwise and counter-clockwise directions by a rotation force transmitted from a drive source; a ribbon feed gear for feeding an ink ribbon capable of rotating about a second shaft; and an intermediate gear which swings about the first shaft while meshing with the drive gear, meshes with the ribbon feed gear at a first position during the rotation of the drive gear in the clockwise direction, meshes with the ribbon feed gear at a second position during the rotation of the drive gear in the counter-clockwise direction, and renders the ribbon feed gear rotate always in the same direction irrespective of the rotation direction of the drive gear.

4 Claims, 5 Drawing Sheets

RIBBON FEED DEVICE

This application is a continuation of application Ser. No. 731,396 filed May 7, 1985, now abandoned.

BACKGROUND OF THE INVENTION

1. Field of the Invention

The present invention relates to a ribbon feed device, and more particularly it relates to a ribbon feed device for feeding a ribbon mounted on the recording section of a recording apparatus.

2. Description of The Prior Art

In a serial printer such as wire dot printers, wires are impacted upon a recording ribbon impregnated with ink so that ink sticks to a recording paper to obtain a desired printing. With such an apparatus, the same portion of a ribbon is not repetitively used in printing characters, but the ribbon is fed succeedingly to the recording position of the apparatus during the advancement of recording in order to use different portions of the ribbon.

Figure 1:
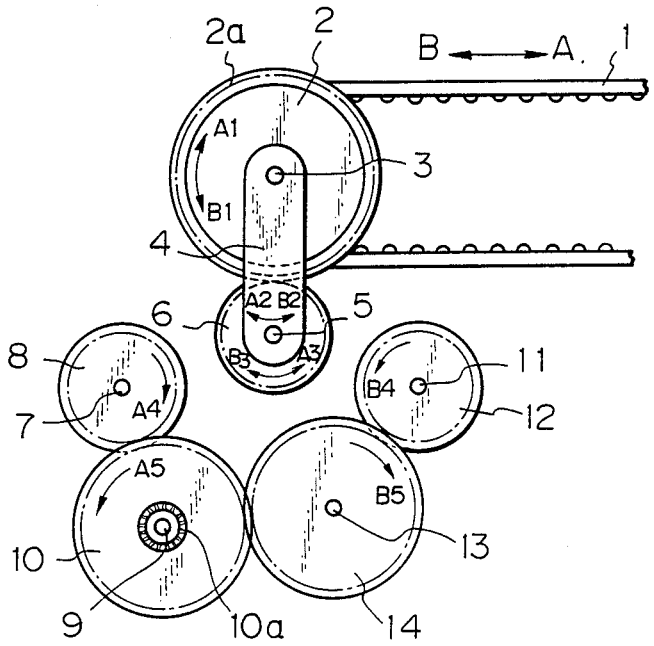
Fig. 1 PRIOR ART

Conventionally, in feeding a ribbon, a method for feeding a ribbon with a motor used exclusively for that purpose has been employed, or a method for feeding a ribbon by power transmitted from the drive system for scanning a carriage back and forth has been employed. Using an exclusive motor however leads to high cost. Therefore, in recent years the latter motor for driving a carriage has been used widely also for feeding a ribbon. FIG. 1 shows the structure of a ribbon feed mechanism of this method.

In FIG. 1, a timing belt represented by numeral 1 is mounted between a pulley 2 and an unrepresented pulley on the right side. Drive power from a motor for example is transmitted to the unrepresented right side pulley, thus scanning a carriage mounted on the timing belt in right and left directions.

The pulley 2 has teeth 2*a* concentrically formed thereon which mesh with swing gear 6 of a small diameter. The swing gear 6 is mounted on a shaft 5 provided on a swing plate 4 which can swing about a shaft 3 of the pulley 2 and the teeth 2*a*. Thus, the swing gear 6 can swing in A2 or B2 direction in response to the rotation of the pulley 2 in A1 or B1 direction while the swing gear 6 meshes with the teeth 2*a*.

Within the swing area of the swing gear 6, gears 8 and 12 having the same number of teeth are rotatably mounted on respective shafts 7 and 11. These gears respectively mesh with gears 10 and 14 having the same number of teeth, the gears 10 and 14 mounted on respective shafts 9 and 13 meshing with each other.

The gear 10 has a spline 10*a* mounted coaxially thereon. The spline 10*a* couples with the drive unit of a ribbon cassette disposed above those gears and feeds the ribbon by the amount corresponding to the rotation of the spline 10*a*. With such construction, as the timing belt 1 is driven in A direction, the pulley 2 rotates in A1 direction. Then, the swing gear 6, while meshing with the teeth 2*a*, swings in A2 direction to thereby mesh with the gear 8.

Upon meshing of the swing gear 6 with the gear 8, the swing plate 4 is prevented from further swing so that the rotation of the pulley 2 is transmitted to the swing gear 6 and to the gears 8 to 10. That is, the swing gear 6 rotates in A3 direction, the gear 8 in A4 direction, and the gear 10 in A5 direction.

On the other hand, as the timing belt 1 is driven in B direction, the swing gear 6 swings in B2 direction opposite to the above-mentioned direction to thereby mesh with the gear 12. As a result, the rotation of the pulley 2 in B1 direction is transmitted to the gear 10 via the swing gear 6 and the gears 12 and 14. That is, the swing gear 6 rotates in B3 direction, the gear 12 in B4 direction, and the gear 14 in B5 direction. Consequently, the gear 10 rotates in A5 direction the same as the direction described above.

In this manner, irrespective of the direction of movement of the carriage, the gear 10 is always driven to rotate in A5 direction, and the ribbon is fed with the spline 10*a* to the recording position always in the same direction.

Figure 2:
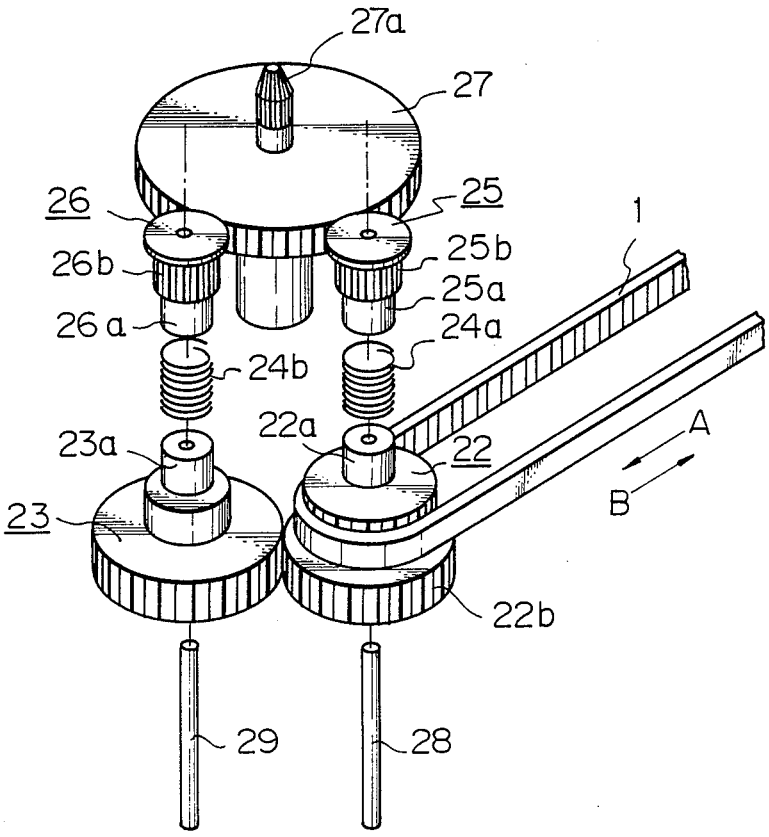
Fig. 2 PRIOR ART
Figure 3A:
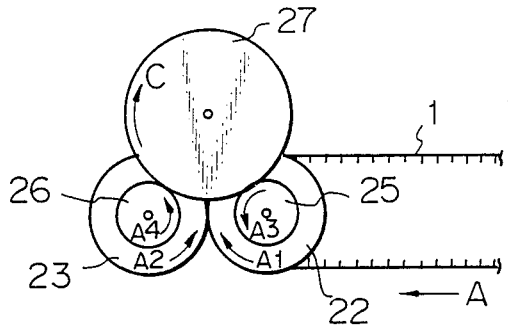
Fig. 3(A) PRIOR ART

Among the ribbon feed methods which utilize a drive power for moving a carriage, also known is a method using a spring clutch as shown in FIG. 2 and FIGS. 3(A) and (B).

FIG. 2 is a perspective and exploded view of a ribbon feed mechanism using such method. A timing belt 1 for driving a carriage is here coupled to a pulley 22. The pulley 22 has a clutch boss 22*a* at its upper portion and a teeth section 22*b* at its lower portion, respectively formed integrally with the pulley 22. The pulley 22 is rotatably mounted on a shaft 28.

The teeth section 22*b* meshes with a gear 23 having the same number of teeth as of the teeth section 22*b*, the gear 23 being integrally formed with a clutch boss 23*a*.

Gears 25 and 26 are coaxially mounted on respected shafts 28 and 29 disposed above the clutch bosses 22*a* and 23*a* via clutch springs 24*a* and 24*b* having opposite winding directions to each other. The gears 25 and 26 comprise respectively teeth sections 25*b* and 26*b*, and clutch bosses 25*a* and 26*a*. The clutch bosses 25*a* and 25*b* are positioned inside of the clutch springs 24*a* and 24*b*.

The gear sections 25*b* and 26*b* mesh with a gear 27 having a spline 27*a* integrally formed therewith for driving a ribbon.

With the construction as above, as the timing belt 1 is driven in A direction, the gear 22 rotates in A1 direction as shown in FIG. 3(A). As a result, the gear 23 rotates in A2 direction. The direction of the rotation is such that the clutch spring 24*b* is compressed and the clutch spring 24*a* is released. Therefore, the rotation is transmitted to the gear 27 via the gears 23 and 26. The gear 26 rotates in A2 direction, while the gear 27 rotates in C direction. The gear 25 rotates in idle in A3 direction while receiving a rotation force from the gear 27.

Figure 3B:
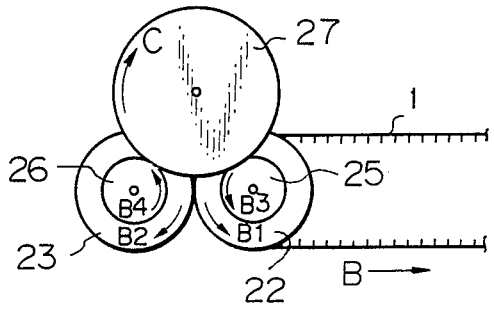
Fig. 3(B) PRIOR ART

On the other hand, as the timing belt 1 is driven in B direction, the gear 22 rotates in B1 direction and the gear 23 rotates in B2 direction, as shown in FIG. 3(B). Since the direction of the rotation is such that the clutch spring 24*a* is compressed and the clutch spring 24*b* is released, the rotation force is transmitted to the gear 27 through the gears 22 and 25, as opposite to the above case. The gear 22 rotates in B1 direction, the gear 25 in B3 direction, and the gear 27 in C direction the same as in the above case. The gear 26 rotates in idle B4 direction.

As seen from the above, the gear 27 is driven always in C direction so that the ribbon is fed in a determined direction to the recording position irrespective of the drive direction of the carriage.

The above two methods have been used widely wherein the drive force for the carriage is utilized for a ribbon feed. With the method of FIG. 1, there are some problems in that the number of components and the occupied plan area are large. Also, with the method shown with FIG. 2 and FIGS. 3(A) and (B), although the number of components is relatively small, a vertical space in the apparatus is required, thereby making it difficult to have a thin apparatus. Furthermore, in order to avoid any clearance for the clutch spring, it is necessary to strictly control the tolerance of dimensions in the thrust direction. Moreover, since a spring will exert a load in a released state, a large, disadvantageous power loss is present.

Still furthermore, the ink ribbon is fed always at a constant speed and in the same direction even if the carriage movement is reversed. Therefore, if the directions of carriage movement and ink ribbon feed are the same, the relative speed between those of the carriage and the ribbon is small. Alternatively, if the directions of carriage movement and ink ribbon feed are opposite, the relative speed becomes very large. Since a large relative speed between those of the ink ribbon and carriage is present, the head on the carriage is liable to scratch the ink ribbon in many cases.

SUMMARY OF THE INVENTION

It is an object of the present invention to provide a ribbon feed device suitable for use with a recording apparatus.

It is another object of the present invention to simplify the structure of a ribbon feed device.

It is still another object of the present invention to miniaturize and thin the structure of a ribbon feed device.

It is a further object of the present invention reduce the relative speed between a carriage and an ink ribbon.

Other objects will become apparent as the description proceeds, when considered with the accompanying drawings in which:

FIG. 1 to FIGS. 3(A) and (B) are views for explaining the structure of a conventional ribbon feed device, wherein FIG. 1 is a plan view of the structure of a conventional ribbon feed device, FIG. 2 is a perspective and exploded view showing the structure of another conventional ribbon feed device, and FIGS. 3(A) and (B) are views for explaining the operation associated with the structure of FIG. 2.

Figure 7:
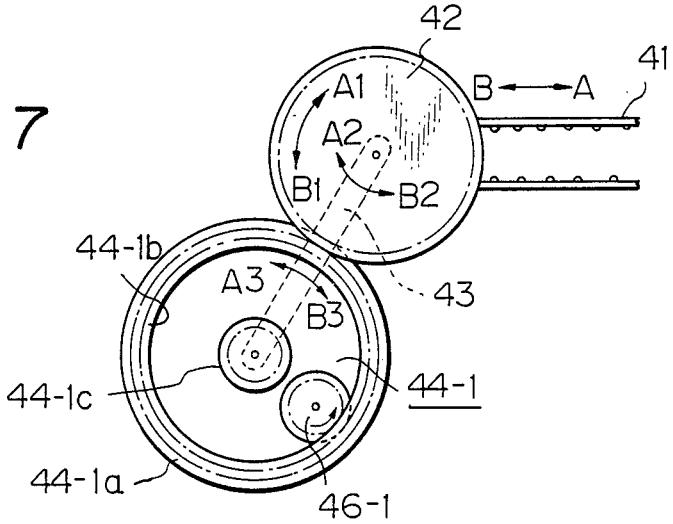
Figure 4:
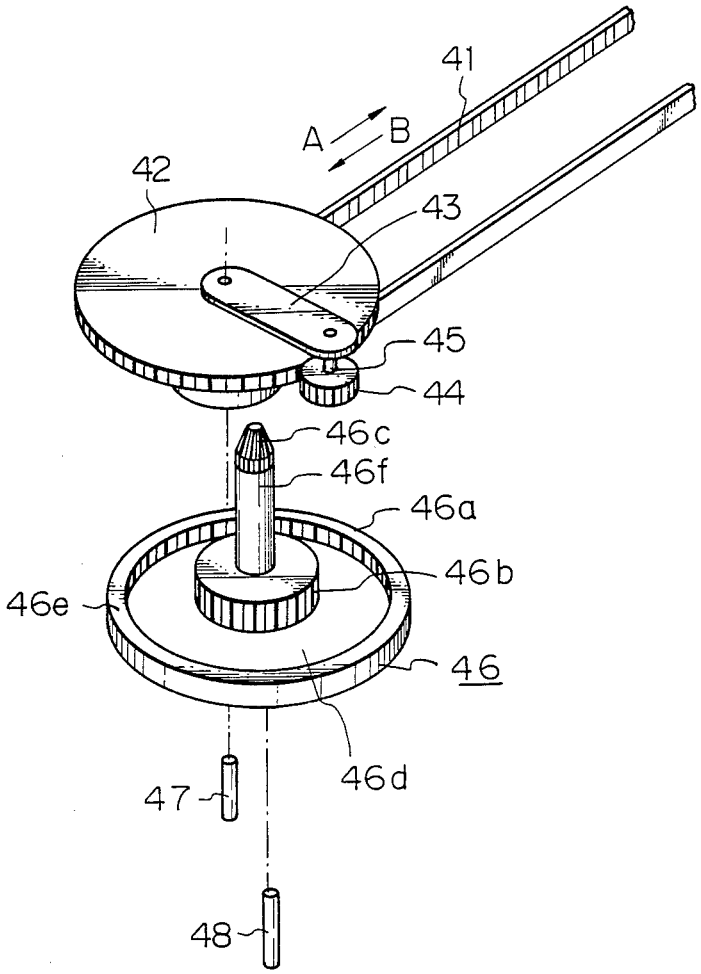
Figure 5:
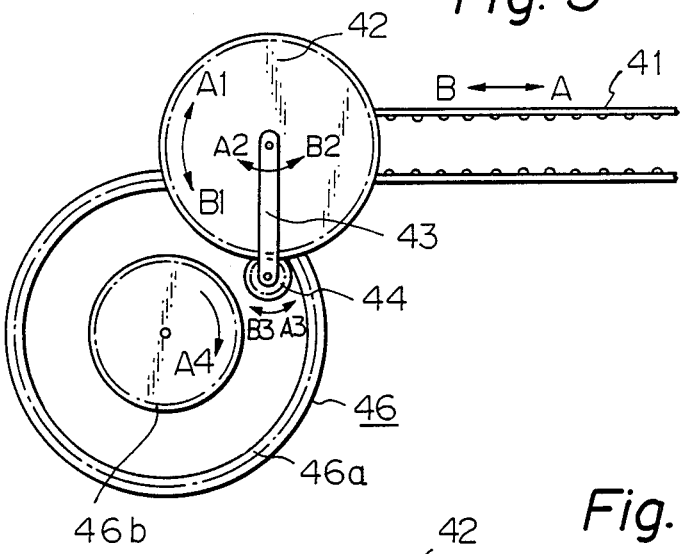
Figure 6:
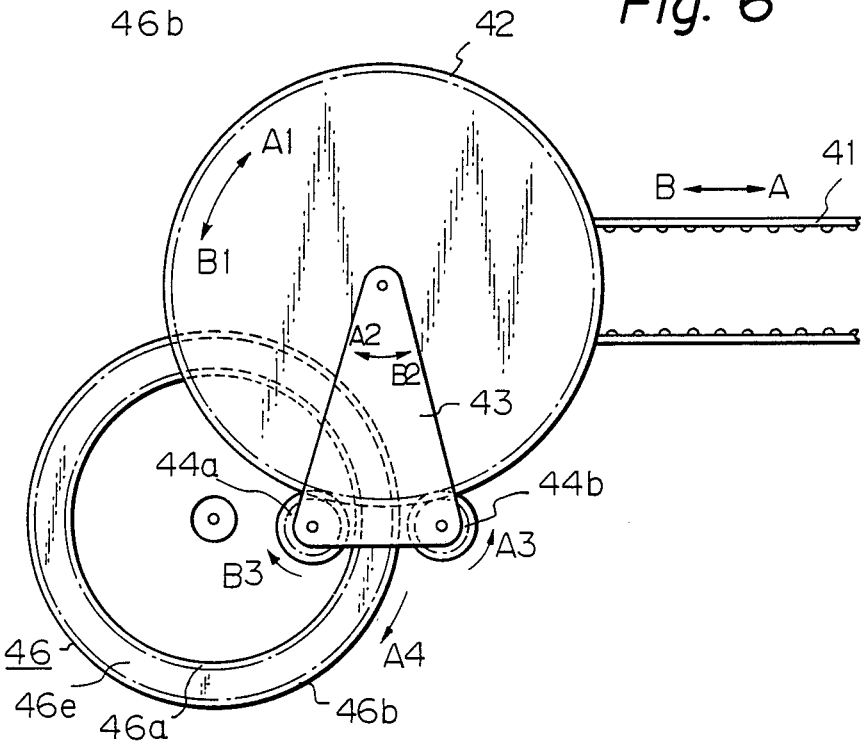

FIG. 4 to FIG. 7 are views for explaining the present invention, wherein FIG. 4 is a perspective and exploded view showing the structure of an embodiment of a ribbon feed device according to the present invention FIG. 5 is a view for explaining the operation associated with the structure of FIG. 4, FIG. 6 is a view for explaining the structure of another embodiment of a ribbon feed device according to the present invention, and FIG. 7 is a view for explaining the structure of a further embodiment of a ribbon feed device according to the present invention.

DESCRIPTION OF THE PREFERRED EMBODOMENT

The present invention will now be described in detail in conjunction with the embodiments shown in the accompanying drawings.

FIG. 4 shows a perspective and exploded view of an embodiment of a ribbon feed mechanism according to the present invention. In the figure, a timing belt for driving a carriage designated by numeral 41 is coupled to a pulley integrally formed with a drive gear 42 at the bottom portion thereof. The timing belt 41 is mounted between the pulley and an unrepresented pully positioned oppositely of the former pulley, and driven by a drive means such as a motor.

The drive gear 42 is mounted on a shaft 47 on which mounted is a swing plate 43 for swinging thereabout. The swing plate 43 is provided with a swing gear 44 constituting an intermediate gear for power transmission, the swing gear 44 being rotatably mounted on a shaft 45 at the tip portion of the swing plate 43. The swing gear 44 meshes with the drive gear 42. The thickness of the swing gear 44 is larger than that of the drive gear 42.

Beneath the drive gear 42, a ribbon feed gear 46 is mounted on a shaft 48. The ribbon feed gear 46 is of a dish shape, with a teeth section **46*a* formed at the inner periphery of a marginal portion 46*e* protruding above the bottom surface 46*d*. Centrally of the bottom surface 46*d*, a teeth section 46*b* is formed facing the teeth section 46*a*. A shaft 46*f* is also formed upright on the teeth section 46*b*, the tip portion of the shaft 46*f* being formed with a spline shaft 46*c*** for driving a ribbon.

The gear 42 is positioned relative to the gear 46 at such height that the swing gear 44 can swing within the space defined by the teeth sections **46*a* and 46*b***.

With the construction as above, as the timing belt 41 is driven in A direction, the gear 42 rotates in A1 direction as shown in FIG. 5. Therefore, the swing plate 43 swings in A2 direction and stops at the position where the swing gear 44 meshes with the teeth section **46*b***.

Consequently, the rotation of the drive gear 42 is transmitted via the swing gear 44 and the gear section **46*b* to the gear 46. In this state, the swing gear 44 rotates in A3 direction, while the gear 46** rotates in A4 direction.

On the other hand, as the timing belt 41 is driven in B direction, the swing plate 43 swings in B2 direction opposite to the above direction. In this case, the swing gear 44 meshes with the teeth section **46*a* of the gear 46. Therefore, the rotation of the drive gear 42 is transmitted via the swing gear 44 and the teeth section 46*a* to the gear 46. Although the gear 42 and the swing gear 44 rotates in the direction opposite to those described above, the swing gear 44 drives the gear 46 by way of the teeth section 46*a* so that the gear 46** rotates in A4 direction similarly to the above.

As seen from the above embodiment, the gear is driven in the same direction irrespective of the direction of carriage movement. Thus, the ribbon is fed by the spline **46*c*** always in the same direction to the recording position. As seen from Figs. 4 and 5, the ribbon feed device according to the present invention can be made of as few as three gears, reducing the number of components and thus enabling a low cost and simple structure of the device as well as a reduction of space occupied by the device. Furthermore, since spring clutches are not used, it is advantageous in that power loss is small.

In the above embodiment, there is a relatively large difference between the diameters of the teeth sections **46*a* and 46*b*** so that the feed reduction ratio varies with the direction of carriage movement. By virtue of the above characteristic nature, it is possible to arrange such that the ink ribbon is fed in the same direction as of the carriage movement at a larger speed while the latter is moved in the forward direction, and that the ink ribbon is fed in the opposite direction as of the carriage movement at a small speed while the latter is moved in the backward direction. With such arrangement, the variation of the relative speed between those of the carriage and the ink ribbon due to the change of the direction of carriage movement can be suppressed at the minimum, thus eliminating the possibility of scratching the ribbon.

Alternatively, another embodiment is shown in FIG. 6 wherein the relative speed between those of the ink ribbon and the carriage is maintained substantially constant. In FIG. 6, identical or similar elements to those of the above described embodiment have been represented by using the same numbers, and the detailed description therefor are omitted.

In the embodiment shown in FIG. 6, on the outer and inner sides of a marginal portion 46e of a gear 46, teeth sections 46a and 46b are formed. In the embodiment, while swing gears 44a and 44b mounted on a swing plate 43 of a generally triangle shape mesh with a gear 42, either one of the gears 44a and 44b swings to mesh with corresponding teeth section 46a or 46b.

With the construction as above, as the timing belt 41 is driven in A direction, the gear 42 rotates in A1 direction. As a result, the swing plate 43 swings in A2 direction to render the swing gear 44b mesh with the teeth section 46b. Thus, the rotation of the drive gear 42 is transmitted via the gear 44b to the teeth section 46b to thereby rotate the gear 46 in A4 direction.

On the other hand, as the timing belt 41 is driven in B direction, the gear 42 rotates in B1 direction, the swing plate swings in B2 direction, and the swing gear 44a meshes with the teeth section 46a. Thus, the rotation of the drive gear 42 is transmitted via the gear 44b to the teeth section 46a. In this case, although the swing gear 44a rotates in B3 direction, since the gear 46 is driven by way of the inner teeth section 46a, the direction of rotation of the gear 46 is the same direction as above, i.e., A4 direction.

Although the number of gears for the embodiment of FIG. 6 increases by one, the ribbon is fed always in the same direction, and the same advantageous effects as those in the previous embodiment can be attained. Moreover, since the inner and outer teeth sections 46a and 46b are formed facing in opposite directions on the marginal portion 46e, the numbers of teeth for the teeth sections are substantially equal to each other, thus it is possible to have a smaller difference between the ribbon feed speeds during the forward and backward movements of the carriage. Although the marginal portion of the gear 46 has been depicted as having a relatively large thickness, it is noted that by thinning the marginal portion so as to make the positions of the teeth sections 46a and 46b closer, the speed reduction ratio can be made substantially equal in both cases of the forward and backward movements of the carriage.

Also, either one of the swing gears 44a meshing with the corresponding teeth sections 46a may be a two stage gear having a determined speed reduction ratio. By doing so, the ribbon feed speed may be made entirely constant irrespective of the direction of the carriage.

FIG. 7 shows still another embodiment of the present invention. In this embodiment, a swing gear 44-1 which swings via a swing plate 43 relative to a drive gear 42 is provided. The swing gear 44-1 has opposed teeth sections 44-1b and 44-1c, and teeth section 44-1a which engage gear 42. A ribbon feed gear 46-1 engages teeth section 44-1b or 44-1c according to the swing direction of the swing gear 44-1.

The above-described ribbon feed device according to the invention is applicable to various kinds of recording apparatuses such as impact printers or wire dot printers so long as they use a ribbon in printing.

I claim:

1. A ribbon feed device for a recording apparatus comprising:

drive means for rotating about a first shaft in clockwise and counter-clockwise directions in connection with a reciprocating motion of a carriage of said recording apparatus, said drive means including a drive gear rotatably supported by said first shaft and having teeth disposed around an outer periphery thereof;

ribbon feed means for feeding an ink ribbon rotating about a second shaft positioned parallel to said first shaft, said ribbon feed means including a gear having first and second concentric circular toothed surfaces having different pitch circle diameters, said first toothed surface being externally geared and said second toothed surface being internally geared, a space between said first and second shafts being smaller than a sum of radii of said drive gear and said ribbon feed means so that a face portion of said ribbon feed means overlaps with a face portion of said drive gear; and a planetary gear positioned between said first toothed surface and said second toothed surface of said ribbon feed means and automatically rotating about said first shaft in a direction of said drive means for transferring rotating power directly from said drive means to said ribbon feed means by meshing with said ribbon feed gear means at said first toothed surface during the rotation of said drive means in said clockwise direction, and meshing with said ribbon feed means at said second toothed surface opposing said first toothed surface when the rotation of said drive means is in said counter-clockwise direction, so as to cause said ribbon feed means to always rotate in the same direction irrespective of the rotational direction of said drive means.

2. A ribbon feed drive for a recording apparatus according to claim 1, wherein said drive means includes a drive source for moving the carriage.

3. A ribbon feed device according to claim 1, wherein said drive means is rotated by a looped timing belt for moving said carriage, and said looped timing belt, said drive gear, said ribbon feed means, and said planetary gear are positioned in planes substantially parallel with each other.

4. A ribbon feed device according to claim 1, wherein said ribbon feed means is provided integrally with a shaft for driving a ribbon on said second shaft.

* * * * *

UNITED STATES PATENT AND TRADEMARK OFFICE

CERTIFICATE OF CORRECTION

PATENT NO. : 4,762,434

DATED : August 9, 1988

INVENTOR(S) : HOROFUMI HIRANO

It is certified that error appears in the above-identified patent and that said Letters Patent is hereby corrected as shown below:

On the Title Page,

AT [73] IN THE ASSIGNEE

"Canon Kabushiki Kaisha, Tokyo, Japan" should read --Canon Denshi Kabushiki Kaisha, Chichibu, Japan--.

AT [73] IN THE INVENTOR

"Horofumi Hirano," should read --Hirofumi Hirano,--.

AT [57] IN THE ABSTRACT

Line 1, "includes;" should read --includes--.

COLUMN 1

Line 64, "gears 8 to 10." should read --gears 8 and 10.--.

COLUMN 2

Line 28, "respected" should read --respective--.
Line 34, "25b" should read --26a--.

COLUMN 3

Line 31, "reduce" should read --to reduce--.
Line 35, --BRIEF DESCRIPTION OF THE DRAWINGS-- should be inserted.
Line 47, "invention" should read --invention,--.

UNITED STATES PATENT AND TRADEMARK OFFICE

CERTIFICATE OF CORRECTION

PATENT NO. : 4,762,434

DATED : August 9, 1988

INVENTOR(S) : HOROFUMI HIRANO

It is certified that error appears in the above-identified patent and that said Letters Patent is hereby corrected as shown below:

Line 57, "EMBODOMENT" should read --EMBODIMENTS--.
Line 68, "pully" should read --pulley--.

COLUMN 4

Line 4, "mounted is" should read --is mounted--.
Line 41, "rotates" should read --rotate--.
Line 45, "gear is" should read --gear 46 is--.

COLUMN 5

Line 27, "plate swings" should read --plate 43 swings--.

COLUMN 6

Line 37, "gear" should be deleted.
Line 48, "drive" should read --device--.

Signed and Sealed this

Second Day of May, 1989

*Attest:*

*Attesting Officer*

DONALD J. QUIGG

*Commissioner of Patents and Trademarks*